US005083529A

United States Patent [19]

Sundheimer

[11] Patent Number: 5,083,529

[45] Date of Patent: Jan. 28, 1992

[54] STEAM GENERATOR WITH RING HEADER, PARTICULARLY FOR A NUCLEAR POWER STATION

[75] Inventor: Patrick Sundheimer, Saint Maur Des Fosses, France

[73] Assignee: Framatome, Courveboie, France

[21] Appl. No.: 651,978

[22] Filed: Feb. 7, 1991

[30] Foreign Application Priority Data

Feb. 8, 1990 [FR] France ..... 90 01472

[51] Int. Cl.[5] ..... F22B 1/02

[52] U.S. Cl. ..... 122/32; 122/235.15; 122/438

[58] Field of Search ..... 122/32, 33, 34, 235.15, 122/360, 438; 239/556, 559

[56] References Cited

U.S. PATENT DOCUMENTS 3,991,720 11/1976 Byerley ..... 122/32
4,037,569 7/1977 Bennett et al. ..... 122/32
4,502,419 3/1985 Smith, Jr. ..... 122/32
4,967,699 11/1990 Hannerz ..... 122/32

*Primary Examiner*—Edward G. Favors
*Attorney, Agent, or Firm*—Pollock, Vande Sande & Priddy

[57] ABSTRACT

A steam generator for a PWR comprise a pressure vessel having an upper portion forming a steam chamber and a bundle of U-shaped exchange tubes within the vessel. A feed-water ring header is located within the pressure vessel above the bundle, extends horizontally and is connected to a feed water inlet nozzle passing through the wall of the pressure vessel, said header having an approximately toridal shape. Feed water is discharged into the pressure vessel above the bundle by crook-shaped tubes each having an end opening into the upper portion of the header of and projecting upwardly from the header. The crook-shaped tubes are spaced apart at substantially equal angular intervals and have respective controlling cross-sectionam flow areas which differ depending on the angular position of the discharge tube on the header.

7 Claims, 3 Drawing Sheets

STEAM GENERATOR WITH RING HEADER, PARTICULARLY FOR A NUCLEAR POWER STATION

BACKGROUND OF THE INVENTION

The invention relates to steam generators of the type comprising a pressure vessel containing a bundle of exchange tubes and whose upper portion forms a steam chamber, a ring header having an approximately toric shape located in the vessel, connected to a feed water intake nozzle passing through the wall of the enclosure and having distribution means for discharging feed water into the enclosure, formed by crook-shaped tubes connected to the header along an upper generatrix thereof.

The invention is particularly suitable for use in nuclear power stations which comprise a steam generator having a bundle of U-shaped exchange tubes through which the primary fluid of the reactor passes.

During normal operation of the reactor, the free surface of the feed water in the enclosure is above the nozzle and the header and the water speed in the nozzle is relatively high. Operation is then satisfactory. It may on the other hand be disturbed during different temporary exceptional conditions.

Steam generators have already been proposed for attenuating the disturbances. French patent No. 2333200 (Westinghouse Electric Corporation) describes a generator having upturned J-shaped discharge tubes which permit the header to remain filled with feed water; one at least of the tubes located close to the water intake nozzle, is shorter than the others and prevents steam from being trapped in the header. The exchange tubes of the bundle being in the form of vertical hair pins with an inlet "hot" leg and an outlet "cold" leg, the tubes are spaced apart with a smaller interval in the portion of the header over the hot leg than in the portion of the header over the cold leg. The dissymmetry of distribution of the openings makes this arrangement unfavorable for the fatigue stresses in the tore-shaped header. Manufacture is moreover complicated by the very close arrangement of the tubes above the hot leg.

Another prior art steam generator differs from the preceding one in that the tubes have an intended wall outside the tore-shaped header, which avoids water hammer in the feed water intake pipe. This document does not deal with the problem raised by the presence of hot legs and cold legs cf the exchange tubes.

SUMMARY OF THE INVENTION

An object of the invention is to provide an improved steam generator of the above-defined type, whose exchange tubes have a cold leg and a hot leg which must be subjected to more intense cooling than the other It is a more specific object to provide a generator which has no dissymmetry of distribution of the discharge tubes and consequently has a better resistance to fatigue and is simple to manufacture.

To this end, there is provided a generator wherein the crook-shaped or inverted J-shaped discharge tubes are distributed at equal angular intervals and have, at least locally, an inner cross-sectional area which differs depending on the position in the header.

That feature may be expressed otherwise: the controlling cross-sectional flow area of the tubes (i.e. the smallest area along the tube, which impresses a maximum head loss) varies depending on the location of the discharge tube.

In practice, the discharge tubes will typically have one or other of two diameters, at least over a fraction of their length, the discharge tubes placed above the hot legs having a larger diameter, whereas the pipes placed above the cold legs have a smaller diameter. When, which is frequently the case, the ratio of the flow rates to be delivered above the hot and cold legs is about 80/20, the ratio between the diameters may be 2/1.

As a general rule the discharge tubes are oriented radially, in alternate directions. With this arrangement the approximately toroidal header may have an overall diameter smaller than when the pipes are all directed inwardly. The possible reduction of diameter may be further increased by directing the outlet of the crook-shaped pipes, not vertically, but obliquely, with a slope with respect to the vertical direction typically between 5° and 30°.

The invention will be better understood from the following description of a particular embodiment of the invention, given by way of non-limiting example. The description refers to the accompanying drawings:

DETAILED DESCRIPTION OF PREFERRED EMBODIMENTS

Figure 1:
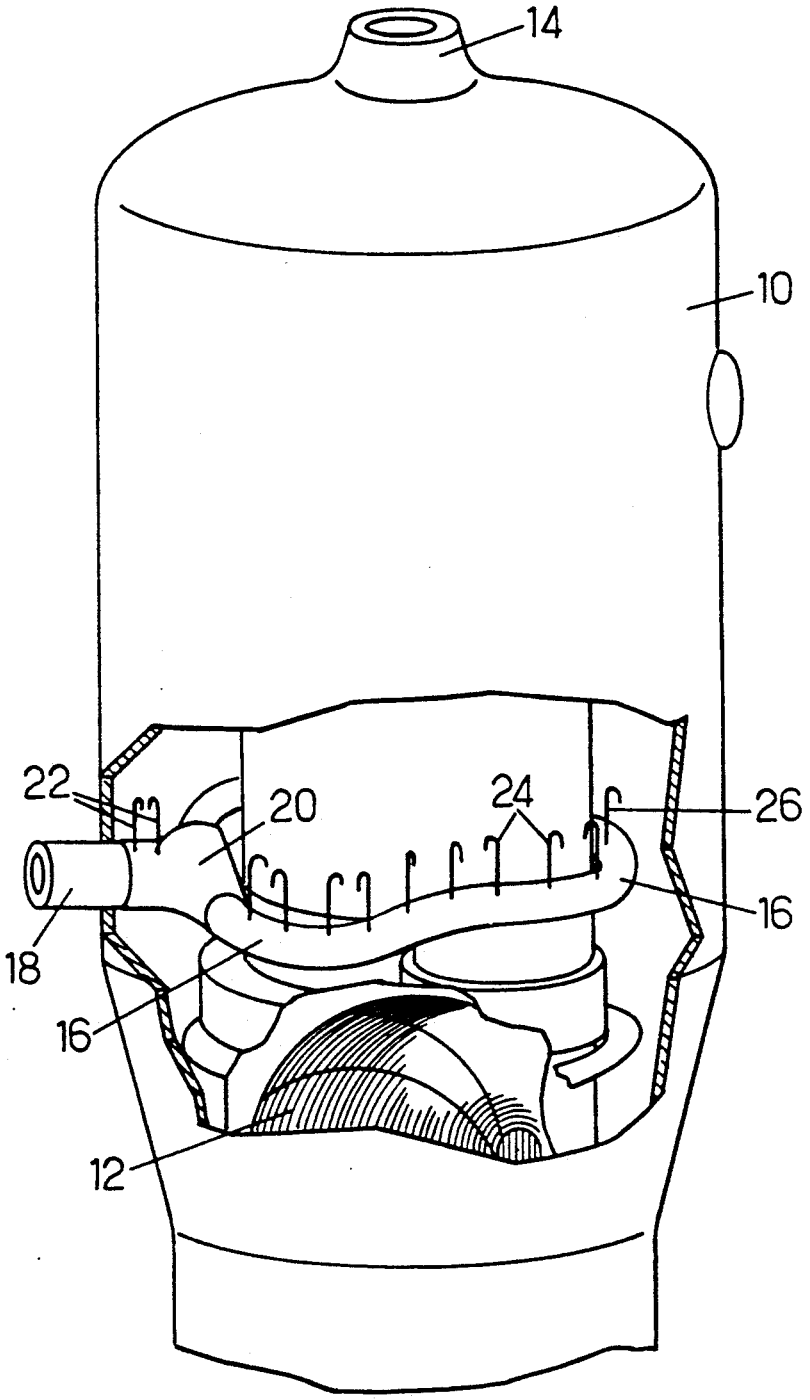
FIG. 1 is a perspective view of a fraction of a steam generator according to the invention.

The steam generator shown in FIG. 1 has a general well-known construction, presently used in nuclear power stations comprising a pressurized water reactor (PWR). This general construction is described for example in French patent No. 2 333 200 already mentioned, to which reference may be made. The exchanger comprises a pressure vessel 10 containing a bundle of hair pin exchange tubes 12 and whose upper portion forms a steam chamber provided with a steam outlet pipe 14. The vessel accommodates a generally tore-shaped header 16, which may or not have lobes (i.e. whose outline may be circular or cloverleaf shaped). A nozzle 18 feeding water to header 16 has a straight horizontal portion fixed to a sleeve (not shown) passing through the vessel 10. It is extended by a section 20 connected to the header 16, forming a connecting T. Nozzle 18 is connected to a main water inlet which receives water, preheated or not, and to an emergency water supply duct, closed during normal operation (neither of which is shown).

Figure 3A:
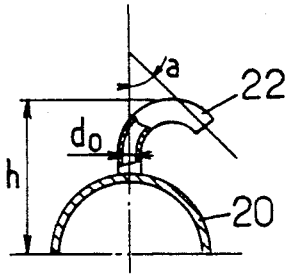
FIG. 3A, similar to FIG. 3, shows a modified embodiment.
Figure 3:
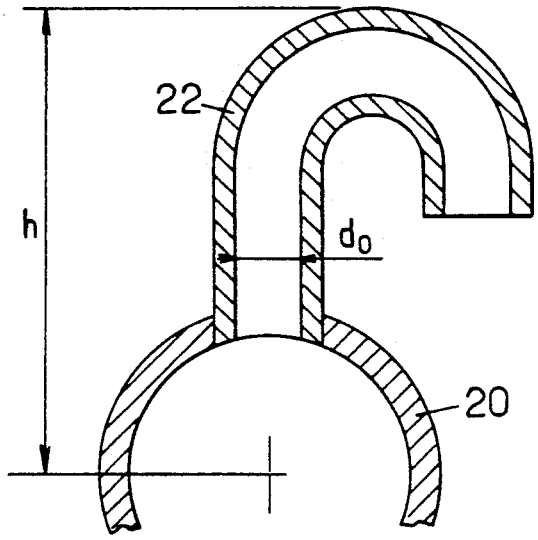

The connecting T 20 is fixed, for example by welding, to the intake nozzle 18 and to the ends of header 16. The intake nozzle 18 or the portion of the T placed upstream of the arms connecting with the header 16 advantageously contain a helicoidal blade deflector as described in European patent No. 0 210 895, which avoids or at least reduces the risk of water hammer. Two crook-shaped tubes are advantageously provided on the connecting T 20. They have an inverted J shape whose long leg opens into the connecting T, at a point located along the upper portion thereof. The two crook-shaped tubes 22 are identical, but directed in opposite directions, transversely to the midplane of the header 16, with a longitudinal offset. These tubes may conventionally be bent in the form of a half circle, as shown in FIG. 3. But, as indicated in FIG. 3A, the loop of the J may be incomplete, so that the direction of the discharged feed water has a slope with respect to the vertical which will generally be between 5° and 30° and the water streams are so directed that they do not strike the wall of the connecting T 20.

The crook-shaped tubes 22 are placed downstream of the deflector, when a deflector is provided.

As shown, header 16 is shaped as a ring having a constant cross-sectional area and a rotational symmetry about the axis of vessel 10. The horizontal midplane of header 16 is at the same level as that of the intake nozzle 18 but its diameter is smaller, since the flow brought by the nozzle is divided between the two outlets of the connecting T 20.

Figure 2:
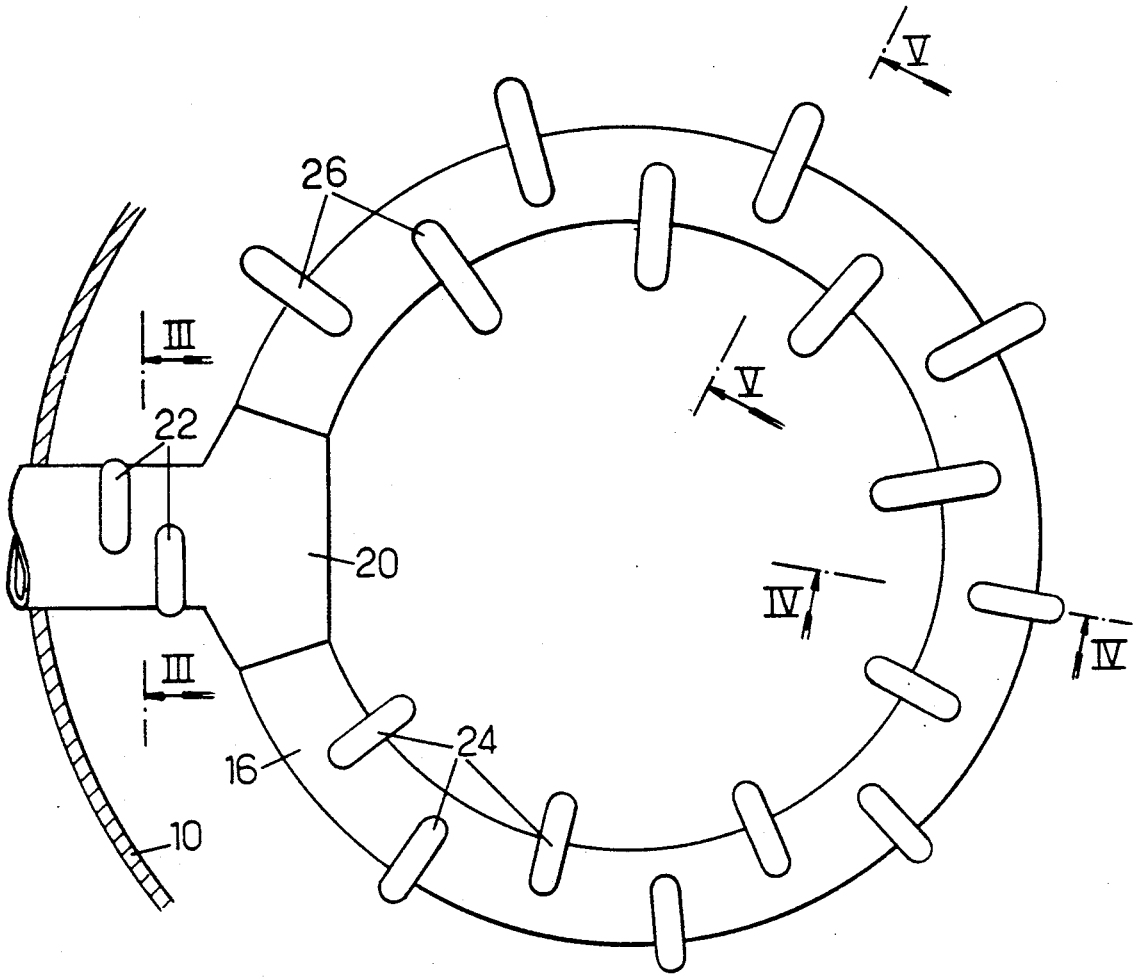
FIG. 2 is a top view of the feed water header and of the supply nozzle in the generator of FIG. 1.

The crook-shaped tubes are spaced apart at equal angular intervals over the header. These tubes, 16 in number in the embodiment illustrated, all have an upturned J shape and are directed radially. But they have alternate directions. When there is a protection deflector (or deflectors) placed in the connecting T 20 or in duct 18, it will often be possible to give the header the shape shown in FIG. 2, i.e. a toroidal shape. The discharge tubes 24 placed above the cold legs of the heat exchange tubes have an inner diameter d less than the internal diameter D of those discharge tubes 26 which open above the hot legs. Often, a diameter D approximately equal to $2d$ will give good results. Often also, it will be possible to adopt, for the internal diameter d0 of tubes 22, a value equal to that of d.

Figure 4:
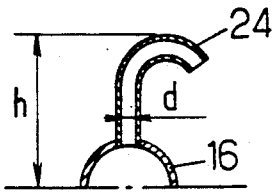
FIGS. 3, 4 and 5 are schematic views in section through lines III—III, IV—IV and V—V of FIG. 2.
Figure 5:
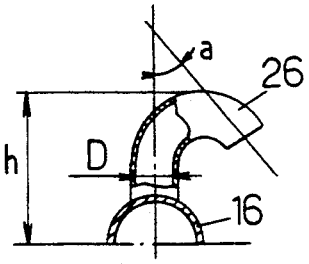

Like tubes 22, tubes 24 and 26 may have either a crook in the form of a half circle, or — as indicated in FIGS. 4 and 5 — an incomplete crook, in that the outlet is oriented so that the water streams leaving the tubes have a slant a with respect to the vertical which is between 5° and 30°. Then the individual flows from the unit comprising the header and tubes mutually diverge and the arrangement makes it possible to give the header a diameter appreciably less than that of vessel 10. Tubes 22 are substituted for the circumferentially spaced tubes on the connecting T 20.

As shown in FIGS. 3, 3A, 4 and 5, the top points of tubes 22, 24 and 26 is at the same level, whatever the cross-section of the component to which they are fixed.

Figure 6:
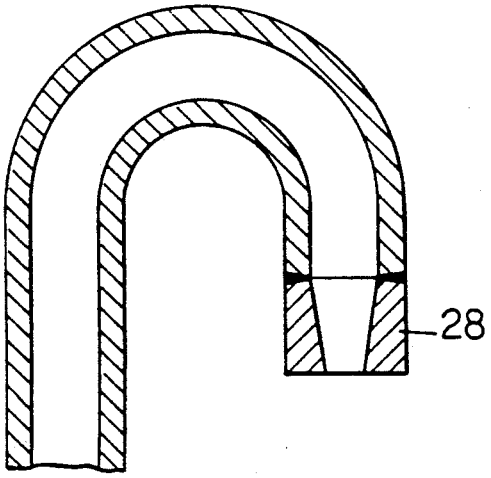
FIGS. 6 and 7, similar to FIG. 3A, show other modifications.
Figure 7:
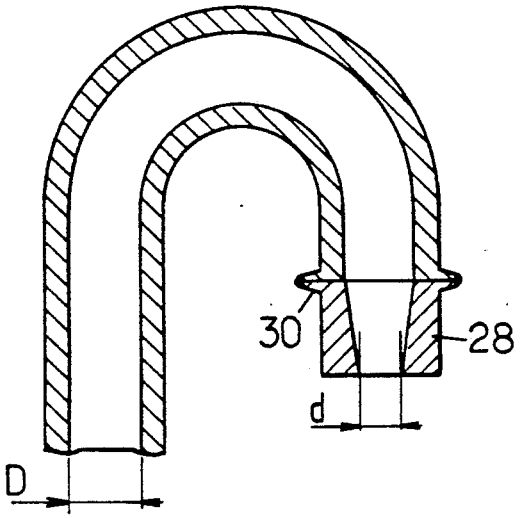

To further standardize the tubes and reduce the number of patterns, the tubes may have cross-sectional flow areas which are different only in a portion of the length of the tubes; all tubes have then the same internal diameter, reduced locally by a diaphragm. In the case illustrated on FIGS. 6 and 7, an end section has been added for local adjustment of the cross-sectional flow area. The end section 28 of FIG. 6 forms a ring with a cylindrical outer surface and a convergent internal surface is secured, for example by welding or brazing, to the end surface of the tube. The end section of FIG. 7 differs from that of FIG. 6 in that it comprises an annular lip 30 for welding to a similar annular lip provided on the tube.

I claim:

1. Steam generator comprising:

a pressure vessel having an upper portion forming a steam chamber;

a bundle of U-shaped heat exchange tubes within the vessel;

a feed-water header located within said pressure vessel above said bundle, extending substantially horizontally and connected to a feed water inlet nozzle passing through a wall of the pressure vessel, said header having an approximately toroidal shape; and feed water distribution means for discharging feed water into the pressure vessel above the bundle, comprising a plurality of crook-shaped tubes each having an end portion opening in the header along an upper portion thereof and projecting upwardly from the header, said crook-shaped tubes being spaced apart at substantially equal angular intervals and having respective controlling cross-sectional flow areas which differ depending on the angular position of the discharge tube on the header.

2. Steam generator according to claim 1, wherein said U-shaped heat exchange tubes have a hot leg in a first portion of the bundle and a cold leg in another portion of the bundle and wherein some of the discharge tubes which are located above the hot legs have a controlling cross-sectional flow area which is circular and whose diameter is substantially twice the diameter of the controlling cross-sectional flow areas of the other of said discharge tubes.

3. Steam generator according to claim 1, wherein all said discharge tubes have mutually identical portions and end pieces defining cross-sectional flow areas which differ depending on the position of the respective discharge tube on the header.

4. Steam generator according to claim 3, wherein each of said end pieces has an inner surface which converges towards the discharge outlet.

5. Steam generator according to claim 1, wherein said discharge tubes are oriented in radial planes and in alternate directions.

6. Steam generator according to claim 1, wherein the discharge outlet of each of said discharge tubes has a slope with respect to the vertical between 5° and 30°.

7. Steam generator comprising:

a pressure vessel;

a plurality of U-shaped heat exchange tubes located within said pressure vessel for circulation of a primary fluid, said exchange tubes each having a hot leg and a cold leg whereby said pressure vessel contains a bundle of hot legs and a bundle of cold legs;

a header located in the pressure vessel above said exchange tubes, directed substantially horizontally and constituting a ring of toroidal shape, said header being connected to a feed water intake duct passing through a wall of said pressure vessel;

a plurality of crook-shaped water discharge tubes spaced apart at substantially equal interval along said header, each communicating with said header along an upper line of said header, wherein some of said discharge tubes which are located above the bundle of cold legs have, at least locally, a cross-sectional flow area which is smaller than the cross-sectional flow area of the other discharge tubes.

* * * * *